US011258148B2

(12) United States Patent
Fiorese et al.

(10) Patent No.: US 11,258,148 B2
(45) Date of Patent: Feb. 22, 2022

(54) WAVEGUIDE DEVICE AND METHOD FOR SEPARATING AND/OR COMBINING ORTHOGONALLY POLARIZED SIGNALS OF RADIOFREQUENCY WAVES

(71) Applicants: STMicroelectronics (Crolles 2) SAS, Crolles (FR); STMicroelectronics SA, Montrouge (FR)

(72) Inventors: Victor Fiorese, Crolles (FR); Frederic Gianesello, Saint Jeoire Prieuré (FR); Florian Voineau, Niort (FR)

(73) Assignees: STMICROELECTRONICS SA, Montrouge (FR); STMICROELECTRONICS (CROLLES 2) SAS, Crolles (FR)

( * ) Notice: Subject to any disclaimer, the term of this patent is extended or adjusted under 35 U.S.C. 154(b) by 0 days.

(21) Appl. No.: 16/901,832

(22) Filed: Jun. 15, 2020

(65) Prior Publication Data

US 2020/0395645 A1 Dec. 17, 2020

(30) Foreign Application Priority Data

Jun. 17, 2019 (FR) ..... 1906471

(51) Int. Cl.

| | |
|---|---|
| ***H01P 1/161*** | (2006.01) |
| ***H01P 1/213*** | (2006.01) |
| ***H01P 5/19*** | (2006.01) |
| ***H01Q 25/00*** | (2006.01) |

(52) U.S. Cl.

CPC ..... *H01P 1/161* (2013.01); *H01P 1/2131* (2013.01); *H01P 5/19* (2013.01); *H01Q 25/001* (2013.01)

(58) Field of Classification Search

CPC ..... H01P 1/161; H01P 1/2131; H01P 5/19; H01Q 25/001

USPC ..... 333/21 A, 126, 135

See application file for complete search history.

(56) References Cited

U.S. PATENT DOCUMENTS

2013/0314172 A1* 11/2013 Massman ..... H01P 5/20 333/122

2015/0295300 A1* 10/2015 Herbsommer ..... H01P 1/2002 333/208

FOREIGN PATENT DOCUMENTS

| | | |
|---|---|---|
| CN | 108011160 A | 5/2018 |
| JP | 2015207863 A | 11/2015 |
| KR | 100967153 B1 | 7/2010 |

OTHER PUBLICATIONS

Machine English Translation of JP2015207863A Published on Nov. 19, 2015 (Year: 2015).*

* cited by examiner

*Primary Examiner* — Rakesh B Patel
*Assistant Examiner* — Jorge L Salazar, Jr.
(74) *Attorney, Agent, or Firm* — Slater Matsil, LLP

(57) ABSTRACT

An orthomode junction for separating and/or combining orthogonally-polarized radiofrequency wave signals, comprises a body which has a main cavity forming a main waveguide, which has a blind end, and auxiliary cavities forming auxiliary waveguides, which communicate laterally with the main cavity in the vicinity of the blind end thereof, and a deflection insert situated at the blind end of the main cavity and facing the auxiliary cavities, the deflection insert having different shapes on the side of the auxiliary cavities respectively.

20 Claims, 4 Drawing Sheets

WAVEGUIDE DEVICE AND METHOD FOR SEPARATING AND/OR COMBINING ORTHOGONALLY POLARIZED SIGNALS OF RADIOFREQUENCY WAVES

CROSS-REFERENCE TO RELATED APPLICATIONS

This application claims the benefit of French Patent Application No. 1906471, filed on Jun. 17, 2019, which application is hereby incorporated herein by reference.

TECHNICAL FIELD

The present invention relates to the field of the transmission (emission and/or reception) of radiofrequency waves.

BACKGROUND

More specifically, the field of transmission devices employing orthogonal polarization duplexers (also known as Orthogonal Mode Transducers, most commonly known by their abbreviation OMT) inserted between an electronic unit able to generate and/or to pick up radiofrequency signals, and an antenna, for example a parabolic antenna.

More specifically, polarization duplexers, or OMTs, are devices which are used to combine in emission mode or to separate in receive mode two orthogonally-polarized (one vertically and one horizontally) signals. Thus, it is possible to use the one same frequency band to emit and receive simultaneously distinct signals of which the electrical fields are mutually perpendicular.

Known polarization duplexers, or OMTs, comprise orthomode junctions for separating/combining orthogonally-polarized radiofrequency wave signals, which junctions are made in a body which has a main cavity forming a main waveguide, which has a blind end and an end generally coupled to an antenna, for example a parabolic antenna, and auxiliary cavities forming auxiliary waveguides, which have ends which communicate laterally with the main cavity in the vicinity of the blind end thereof, and ends which are coupled to an electronic unit. The adjacent parts of the main cavity that form a main waveguide, and of the auxiliary cavities that form auxiliary waveguides, are generally referred to as junctions.

Nevertheless, it is essential that, in emission and/or in reception, these junctions provide inter-polarization isolation between the two orthogonally-polarized signals so as to avoid exchanges of energy that would produce interference and noise detrimental to the communication.

SUMMARY

An embodiment orthomode junction for separating and/or combining orthogonally-polarized radiofrequency wave signals, comprises a body which has a main cavity forming a main waveguide, which has a blind end, and auxiliary cavities forming auxiliary waveguides, which communicate laterally with the main cavity in the vicinity of the blind end thereof, and a deflection insert situated at the blind end of the main cavity and facing the auxiliary cavities, the deflection insert having different shapes on the side of the auxiliary cavities respectively.

Thus, in emission and/or in reception, the inter-polarization isolation between the two orthogonally-polarized signals is improved.

The auxiliary cavities may communicate with the main cavity at opposing points.

The main cavity may comprise a main portion, adjacent to the blind end, of cylindrical cross section, and the auxiliary cavities may comprise auxiliary portions, adjacent to the cylindrical portion, of rectangular cross sections.

The axes of the rectangular auxiliary portions of the auxiliary cavities may intersect the axis of the cylindrical main portion of the main cavity orthogonally.

The rectangular auxiliary portions of the auxiliary cavities may be diametrically opposed with respect to the cylindrical main portion of the main cavity.

The long sides of one of the rectangular auxiliary portions may extend longitudinally with respect to the main cavity, and the long sides of the other rectangular auxiliary portion may extend orthogonally with respect to the main cavity.

The deflection insert may comprise parts which have opposing domed faces on the side of, or facing, the auxiliary cavities respectively.

One of the domed faces may be larger than the other domed face.

The deflection insert may comprise a projecting part which has opposing domed faces on the side of, or facing, the auxiliary cavities respectively.

The junction may be the result of manufacture by 3D printing.

BRIEF DESCRIPTION OF THE DRAWINGS

An orthomode junction for separating and/or combining orthogonally-polarized radiofrequency wave signals will now be described by way of non-limiting example, illustrated by the drawing in which.

DETAILED DESCRIPTION OF ILLUSTRATIVE EMBODIMENTS

Figure 1:
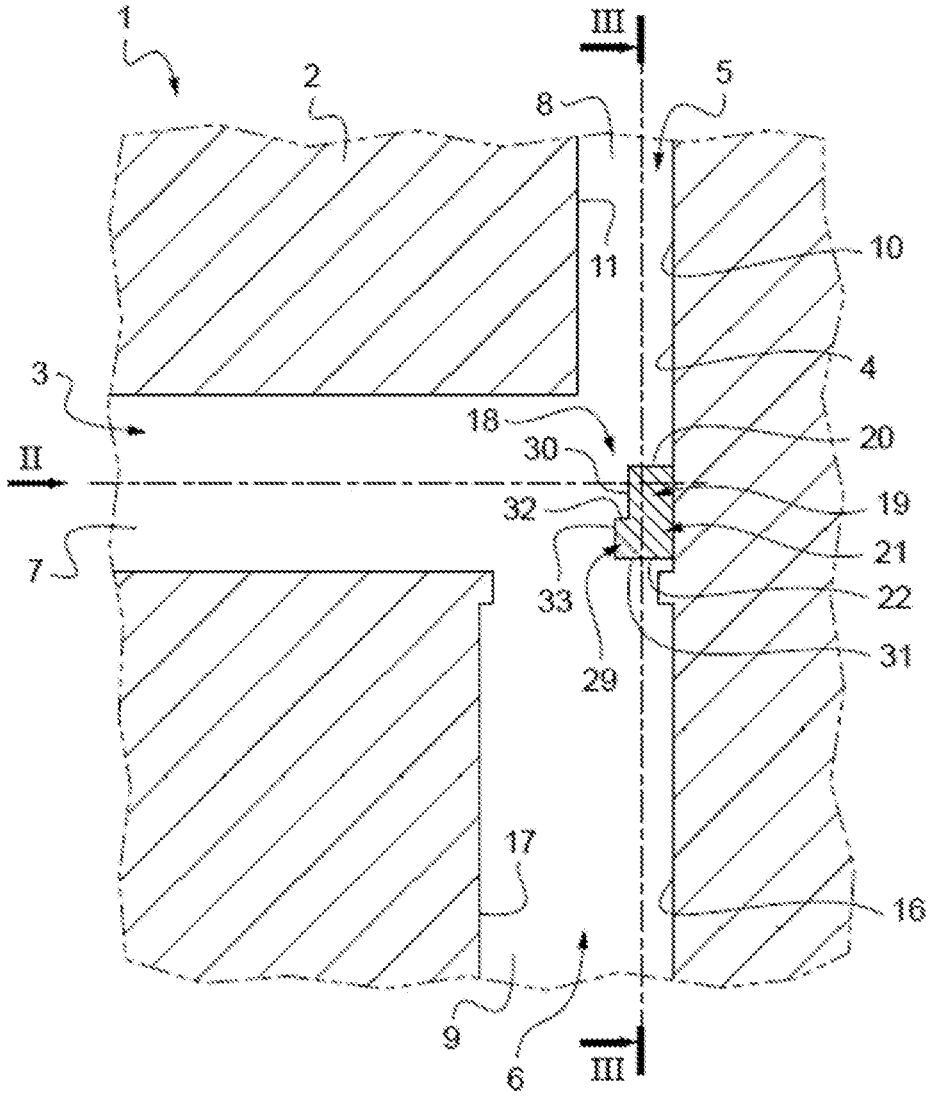
FIG. 1 depicts a partial longitudinal section through a junction.
Figure 2:
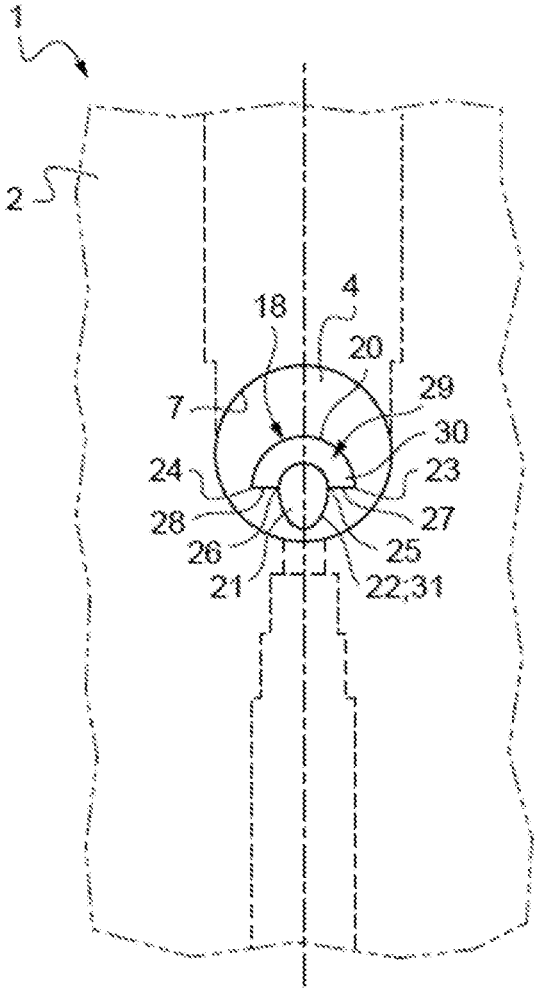
FIG. 2 depicts an axial view of the said junction, in the direction of II-II of FIG. 1.
Figure 3:
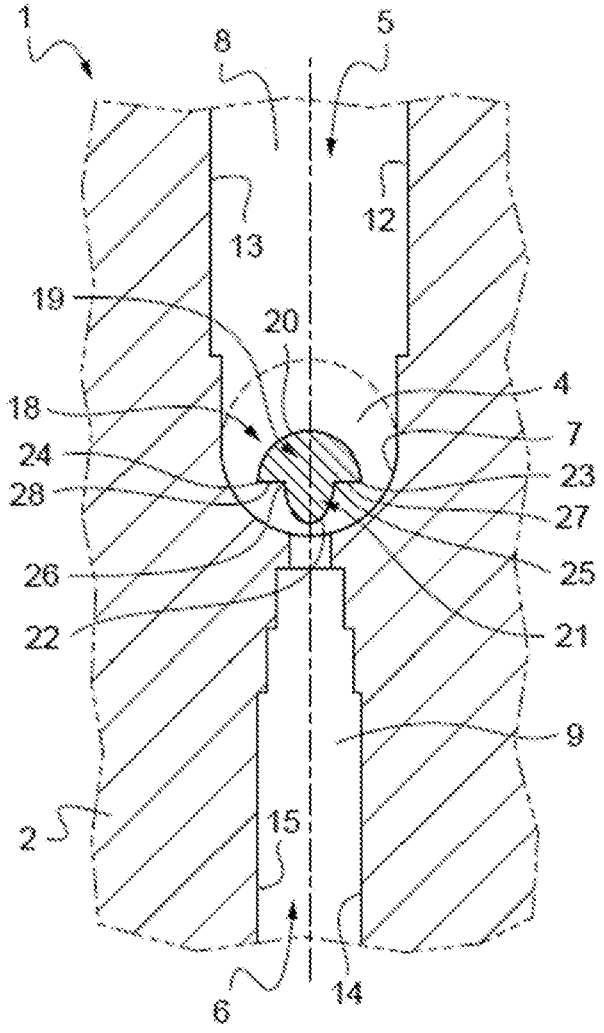
FIG. 3 depicts a partial radial section through the said junction, on III-III of FIG. 1.
Figure 4:
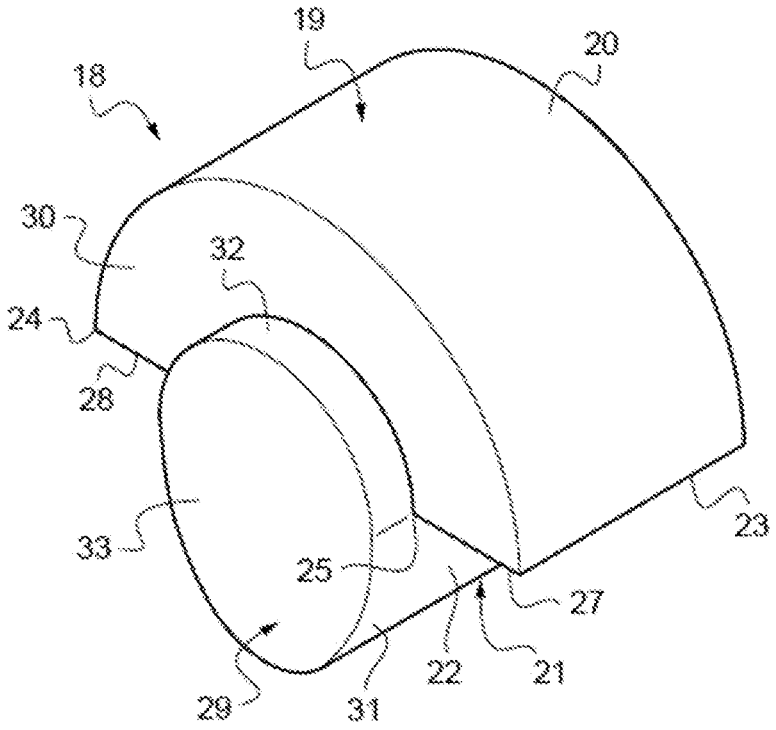
FIG. 4 depicts a perspective view of a deflection insert of the said junction.

A junction 1, included in a polarization duplexer, or OMT, with a view to separating and/or combining orthogonally-polarized radiofrequency wave signals, comprises a body 2 in which there are formed a main cavity 3 that forms a main waveguide, which has a blind end 4, and auxiliary cavities 5 and 6 that form auxiliary waveguides, which communicate laterally with the main cavity 3 in the vicinity of the blind end 4 thereof.

More specifically, according to one alternative form of embodiment, the main cavity 3 comprises a main terminal portion 7, adjacent to the blind end 4, and of cylindrical cross section, the blind end 4 being arranged radially with respect to this cylindrical terminal portion 7.

The main end portion 7 is extended in the opposite direction to the radial blind end 4 by a junction portion, not depicted, which is routed, along a path of suitable shape, so that its terminal end is coupled to an antenna, for example a parabolic antenna, not depicted, able to emit and/or to pick up a radiofrequency wave.

The auxiliary cavities 5 and 6 comprise auxiliary terminal portions 8 and 9, of rectangular cross sections, which communicate radially with the main terminal portion 7 of the main cavity 3 in the vicinity of the radial blind end 4 and which are situated so that they are diametrically opposed with respect to the main terminal portion 7.

The auxiliary terminal portions 8 and 9 are extended in the opposite direction to the radial blind end 4 by a connecting portion, not depicted, and are routed, along paths of suitable shape, so that their terminal ends are coupled to distinct means able to emit and/or to pick up radiofrequency waves, belonging to an electronic unit, not depicted.

The auxiliary terminal portion 8 is situated in such a way that its axis intersects the axis of the main terminal portion 7 at right angles, that its opposite long sides 10 and 11 are situated radially with respect to the main terminal portion 7, that its opposite short sides 12 and 13 are situated longitudinally with respect to the main terminal portion 7, and that the distance between its opposite short sides 12 and 13 is equal to the diameter of the main terminal portion 7 so as to meet the latter tangentially.

The auxiliary terminal portion 9 is situated in such a way that its axis intersects the axis of the main terminal portion 7 at right angles, that its opposite long sides 14 and 15 are situated longitudinally with respect to the main terminal portion 7, that its opposite short sides 16 and 17 are situated radially with respect to the main terminal portion 7, and that the distance between its opposite long sides 14 and 15 is less than the diameter of the main terminal portion 7.

The junction 1 is configured in such a way as to operate as follows.

In receive mode, a radiofrequency wave including orthogonally-polarized signals, for example coming from the aforementioned antenna, is routed in the main cavity 3 towards the blind end 4.

From the main terminal portion 7 of the main cavity 3, this radiofrequency wave is split, heading towards the auxiliary cavities 5 and 6, into two radiofrequency waves respectively including the orthogonally-polarized signals.

These separated radiofrequency waves enter the terminal portions 8 and 9 of the auxiliary cavities 5 and 6 and are then routed through the auxiliary cavities 5 and 6 towards the aforementioned pick-up means of the aforementioned electronic unit. The electronic unit therefore processes the received signals separately.

Reciprocally, in emit mode, the aforementioned emission means of the aforementioned electronic unit emit radiofrequency waves respectively including distinct orthogonally-polarized signals, into the auxiliary cavities 5 and 6 respectively.

The radiofrequency waves are routed through the auxiliary cavities 5 and 6, passed through the terminal portions 8 and 9 and then enter the terminal portion 7 of the main cavity 3. Therefore, the radiofrequency waves coming from the auxiliary cavities 5 and 6 combine to form a resultant radiofrequency wave including the distinct orthogonally-polarized signals.

This resultant radiofrequency wave is then routed through the main cavity 3 away from the radial end 4, as far as the aforementioned antenna.

In a two-way communication mode, one of the two electronic units emits radiofrequency waves while the second electronic unit receives radiofrequency waves in the same frequency band but with orthogonal polarization. The wave emitted by the emitting electronic unit travels through the structure as described hereinabove. At the same time, the signal picked up by the receiving other electronic unit, and which comes from the antenna, travels through the structure in the opposite direction with an orthogonal polarization mode, as described hereinabove.

It is evident from the foregoing that the junction 1 is able to combine in one direction of traffic and to separate in the other direction of traffic, on the one same frequency band, distinct signals, the electric fields of which are mutually perpendicular.

The junction 1 further comprises a deflection insert 18 which is situated to project with respect to the blind end 4 of the main cavity 3 and facing the auxiliary cavities 8 and 9 so as to facilitate the separating and/or the combining of the orthogonally-polarized signals.

Advantageously, the deflection insert 18 has different shapes respectively facing or on the side of the auxiliary cavities 5 and 6. The face of the deflection insert 18 has, on the opposite side to the radial end 4, a shape that is discontinuous.

According to one exemplary embodiment, the deflection insert 18 is configured as follows.

The deflection insert 18 is placed against the radial end 4 of the terminal portion 7 of the main cavity 3 and comprises a part 19 which, on the side of the auxiliary cavity 5, has a domed face 20 the generatrices of which extend parallel to the axis of the terminal portion 7, and a part 21 which, on the side of the auxiliary cavity 6, has a domed face 22 the generatrices of which extend parallel to the axis of the terminal portion 7, the faces 20 and 22 being opposed and domed in opposite directions.

Perpendicular to the parallel axes of the terminal portions 8 and 9 of the auxiliary cavities 5 and 6, the domed face 20 is, between the terminal generatrices 23 and 24, larger than the domed face 22, between the terminal generatrices 25 and 26. The face 20 is not as domed as the face 22.

The part 19 has flat faces 27 and 28 which respectively join the terminal generatrices 23 and 24 and the terminal generatrices 25 and 26 and which are situated on either side of the part 21 and on the side of the auxiliary cavity 6. The flat faces 27 and 28 are in the one same plane which is perpendicular to the axes of the terminal portions 8 and 9 of the auxiliary cavities 5 and 6.

For example, the domed faces 20 and 22 have cross sections in the form of portions of circles or of ellipses.

The deflection insert 18 further comprises, on the opposite side to the radial end 4, a part 29 that projects with respect to a radial end face 30 of the part 19. The projecting part 29 has, on the side of the auxiliary cavity 6, a domed face 31 which extends the domed face 22 and, on the side of the auxiliary cavity 5, a domed face 32 which extends from the radial face 30 of the part 19, the domed faces 31 and 32 meeting in the continuation of the generatrices 25 and 26. The projecting part 29 has a radial end face 33.

According to an alternative form of embodiment, the edge corners of the deflection insert 18 could be chamfered.

The deflection insert 18 is offset towards the auxiliary cavity 6 with respect to the axis of the main portion 7 of the main cavity 3.

According to an alternative form of manufacture, the body 2 of the junction 1 may comprise several assembled parts, the deflection insert 18 being added at the moment of assembly.

According to another alternative form of manufacture, the body 2 of the junction 1 may be obtained directly using a 3D printing system.

What is claimed is:

1. A waveguide device for separating and/or combining orthogonally-polarized radiofrequency wave signals, the waveguide device comprising:

a body;

a main cavity forming a main waveguide in the body, wherein the main cavity has a blind end;

two auxiliary cavities forming two auxiliary waveguides in the body;

an orthomode junction formed in a vicinity of the blind end where the two auxiliary cavities communicate laterally with the main cavity; and the orthomode junction comprising a deflection insert disposed at the blind end of the main cavity, the deflection insert comprising portions having opposing domed faces facing the two auxiliary cavities, respectively, wherein one of the domed faces is smaller than the other domed face, wherein the deflection insert comprises flat faces facing a same auxiliary cavity as the smaller domed face, and wherein the flat faces extend from a first outer edge of the smaller domed face to a second outer edge of the larger domed face.

2. The waveguide device according to claim 1, wherein the two auxiliary cavities communicate with the main cavity at opposing points.

3. The waveguide device according to claim 1, wherein the main cavity comprises a cylindrical main portion, adjacent to the blind end, of cylindrical cross section, and wherein the two auxiliary cavities comprise rectangular auxiliary portions, adjacent to the cylindrical main portion, of rectangular cross sections.

4. The waveguide device according to claim 3, wherein axes of the rectangular auxiliary portions of the two auxiliary cavities orthogonally intersect an axis of the cylindrical main portion of the main cavity.

5. The waveguide device according to claim 3, wherein the rectangular auxiliary portions of the two auxiliary cavities are diametrically opposed with respect to the cylindrical main portion of the main cavity.

6. The waveguide device according to claim 3, wherein first long sides of one of the rectangular auxiliary portions extend longitudinally with respect to the main cavity, and wherein second long sides of the other rectangular auxiliary portion extend orthogonally with respect to the main cavity.

7. The waveguide device according to claim 1, wherein the deflection insert further comprises a projecting portion having second opposing domed faces facing the two auxiliary cavities, respectively.

8. The waveguide device according to claim 1, wherein the larger domed face is symmetrically cylindrical, and the smaller domed face is asymmetrically cylindrical.

9. The waveguide device according to claim 1, wherein the larger domed face has a consistent radius, and the smaller domed face has a varying radius.

10. A method of forming a waveguide device for separating and/or combining orthogonally-polarized radiofrequency wave signals, the method comprising:

forming a main cavity in a body to form a main waveguide, the main cavity having a blind end;

forming two auxiliary cavities in the body to form two auxiliary waveguides; and forming an orthomode junction in a vicinity of the blind end where the two auxiliary cavities communicate laterally with the main cavity, the forming the orthomode junction comprising:

forming a deflection insert disposed at the blind end of the main cavity, the deflection insert comprising portions having opposing domed faces facing the two auxiliary cavities, respectively, one of the domed faces being smaller than the other domed face, the deflection insert comprising flat faces facing a same auxiliary cavity as the smaller domed face, and the flat faces extending from a first outer edge of the smaller domed face to a second outer edge of the larger domed face.

11. The method according to claim 10, wherein the two auxiliary cavities communicate with the main cavity at opposing points.

12. The method according to claim 10, further comprising:

forming a cylindrical main portion of the main cavity, adjacent to the blind end, of cylindrical cross section, and forming rectangular auxiliary portions of the two auxiliary cavities, adjacent to the cylindrical main portion, of rectangular cross sections.

13. The method according to claim 12, wherein axes of the rectangular auxiliary portions of the two auxiliary cavities orthogonally intersect an axis of the cylindrical main portion of the main cavity.

14. The method according to claim 12, wherein the rectangular auxiliary portions of the two auxiliary cavities are diametrically opposed with respect to the cylindrical main portion of the main cavity.

15. The method according to claim 12, wherein first long sides of one of the rectangular auxiliary portions extend longitudinally with respect to the main cavity, and second long sides of the other rectangular auxiliary portion extend orthogonally with respect to the main cavity.

16. The method according to claim 10, wherein the larger domed face is symmetrically cylindrical, and the smaller domed face is asymmetrically cylindrical.

17. The method according to claim 10, wherein the larger domed face has a consistent radius, and the smaller domed face has a varying radius.

18. The method according to claim 10, wherein forming the deflection insert comprises forming a projecting portion having second opposing domed faces facing the two auxiliary cavities, respectively.

19. The method according to claim 10, further comprising forming the waveguide device using a 3D printing system.

20. The method according to claim 10, wherein the waveguide device comprises assembled parts, the method further comprising adding the deflection insert as a separate part to the orthomode junction.

* * * * *